US006289570B1

(12) United States Patent
Peterson et al.

(10) Patent No.: US 6,289,570 B1
(45) Date of Patent: Sep. 18, 2001

(54) DIE AND METHOD FOR ASSEMBLING METAL SPOOL HAVING HIGH TORQUE TRANSMITTING CAPACITY BETWEEN SPOOL COMPONENTS

(75) Inventors: Richard L. Peterson, Roscoe; Walter P. Pietruch, Belvidere; Donald Leni, Rockford; Ewald A. Oppmann, Belvidere, all of IL (US)

(73) Assignee: J. L. Clark, Inc., Rockford, IL (US)

( * ) Notice: Subject to any disclaimer, the term of this patent is extended or adjusted under 35 U.S.C. 154(b) by 0 days.

(21) Appl. No.: 09/318,425

(22) Filed: May 25, 1999

(51) Int. Cl.[7] ..... B23P 25/00

(52) U.S. Cl. ..... 29/458; 29/798; 29/243.511; 29/243.518; 29/509; 403/279; 403/281; 144/14; 242/607; 413/26; 413/32; 53/331

(58) Field of Search ..... 29/458, 798, 243.517, 29/243.518, 509; 403/279, 281; 144/14; 242/607, 608, 608.2, 608.7, 609.1; 413/2, 4, 8, 26, 32; 53/341, 342, 329.3, 324, 331

(56) References Cited

U.S. PATENT DOCUMENTS

| | | |
|---|---|---|
| 213,761 | 4/1879 | Lambert . |
| 218,646 | 8/1879 | Taft . |
| 715,729 | 12/1902 | Zimmermann . |
| 851,366 | 4/1907 | Mossberg . |
| 860,521 | 7/1907 | Brinley et al. . |
| 1,599,504 | 9/1926 | Underwood . |
| 1,697,777 | 1/1929 | Mossberg . |
| 1,699,700 | 1/1929 | Kjellstrom . |
| 1,712,278 | 5/1929 | Mills . |
| 1,712,279 | 5/1929 | Mills . |
| 1,754,274 | 4/1930 | Kjellstrom . |
| 1,792,753 | 2/1931 | Mills . |
| 1,818,149 | 8/1931 | Mills . |
| 1,825,508 | 9/1931 | Collins . |
| 1,836,974 | 12/1931 | Kjellstrom . |
| 1,843,235 | 2/1932 | Kjellstrom . |

(List continued on next page.)

*Primary Examiner*—S. Thomas Hughes
*Assistant Examiner*—John C. Hong
(74) *Attorney, Agent, or Firm*—Leydig, Voit & Mayer, Ltd

(57) ABSTRACT

A die and method of assembling a high torque capacity metal spool. The spool comprises a cylindrical barrel, a pair of flanges and a pair of flange hubs. The die includes a support member and a curling member that is adapted to move relative to the support housing. The die is adapted to be driven towards a matching die to press a spool therebetween. Each curling member includes an annular curling face which is adapted to curl and compress metal edges of the cylindrical barrel, the flanges and the flange hubs into tightened curls. The tightened curls secure the cylindrical barrel with the flanges and flange hubs. Each die further includes a plurality of nibs carried by the support housings which project outward from the curling face of the curling member after the tightened curls have been formed to swage a plurality of detents into the tightened curls of the spool. The resulting detents in the metal spool provide for increased torque transfer between the flanges, the flange hubs and the cylindrical barrel. The ability to transfer torque increases the applicability of the spool to wire winding and pulling functions. Flattening paste also covers a metal surface in the curl to increase the coefficient of friction therein and increase the torque transmissibility capacity.

12 Claims, 9 Drawing Sheets

U.S. PATENT DOCUMENTS

| | | | | |
|---|---|---|---|---|
| 1,892,356 | | 12/1932 | Mills . | |
| 1,920,420 | | 8/1933 | Mills | 242/123 |
| 1,920,421 | | 8/1933 | Mills | 242/123 |
| 1,920,422 | | 8/1933 | Mills | 242/123 |
| 1,950,738 | | 3/1934 | Mills | 242/55 |
| 1,973,771 | | 9/1934 | Mills | 242/123 |
| 1,985,505 | | 12/1934 | Kjellstrom | 242/123 |
| 2,006,218 | * | 6/1935 | Schwartz . | |
| 2,121,234 | | 6/1938 | Howsam | 242/123 |
| 2,147,228 | | 2/1939 | Anderson | 242/123 |
| 2,152,522 | | 3/1939 | McCann | 242/77 |
| 2,261,841 | | 11/1941 | Booth | 242/70 |
| 2,275,212 | * | 3/1942 | Valentine . | |
| 2,292,545 | | 8/1942 | Proctor | 242/118 |
| 2,574,845 | | 11/1951 | Schaefer | 242/123 |
| 2,720,179 | | 10/1955 | Strocco | 112/251 |
| 3,108,758 | | 10/1963 | Hill | 242/77.3 |
| 3,135,380 | | 6/1964 | Rich | 206/52 |
| 3,552,677 | | 1/1971 | Hacker | 242/118.61 |
| 3,704,838 | | 12/1972 | Bernier et al. | 242/77.3 |
| 3,876,073 | | 4/1975 | Herbetko | 206/400 |
| 4,128,215 | | 12/1978 | Underwood | 242/118.61 |
| 5,035,355 | | 7/1991 | Dollhopf | 228/104 |
| 5,727,752 | | 3/1998 | Matsuzoe | 242/608.6 |

* cited by examiner 122
121
124
128
154
146
130
122
18
120
156
158
174
146
144
174
134
126
158
18
12
121
152
158
124
132
154
141
156
136
174
120
18
176
122

DIE AND METHOD FOR ASSEMBLING METAL SPOOL HAVING HIGH TORQUE TRANSMITTING CAPACITY BETWEEN SPOOL COMPONENTS

FIELD OF THE INVENTION

The present invention relates generally to metal spools such as those used for wire, and tools and methods of assembling such spools.

BACKGROUND OF THE INVENTION

There are wide variety of spools available for carrying relatively heavy loads of wire, cable and the like. Spools for heavy load applications have traditionally been manufactured from such materials as sheet metal, plastic, wood, and cast iron. From the economic standpoint of material, transportation and assembly costs, it is particularly advantageous to provide such a spool made from sheet metal. Sheet metal has a characteristic of being relatively rigid while being relatively thin which allows the separate sheet metal components of the spool to be fabricated at a metal manufacturer, shipped closely together in large volume to a wire or cable manufacturer, and assembled at the plant of the wire or cable manufacture for receipt of wire or cable. Conventional sheet metal spools have been manufactured relatively inexpensively from either three-pieces or five-pieces of separate sheet metal components. It is also known to provide more complex sheet metal spools made from more pieces, however, more complex sheet metal spools diminish the economic cost advantages of three-piece and five-piece spools.

Five-piece spools typically comprise a cylindrical barrel upon which wire is wound, and a pair of two-piece flange sub assemblies disposed at respective ends of cylindrical barrel. Each flange sub assembly includes two pieces including a generally disc-shaped outer flange having a central opening, and a flange hub disposed in the opening and joined to the flange by a loose curl. Each flange sub assembly is secured to the cylindrical barrel by a tightened curl formed of closely interfitting curled metal edges of the flange hub, the flange and the cylindrical barrel. The tightened curl achieves a relatively rigid, high strength spool that is capable of carrying large loads of wire or cable and capable of being stacked and transported without falling apart or disassembling. Usually, the cylindrical barrel and the flange sub assembly are formed at the metal fabrication plant which allows the cylindrical barrels and flange sub assemblies to be shipped closely together thereby minimizing void space during transport. Then the final assembly of the cylindrical barrels to the flange sub assemblies occurs at the plant of the wire or cable manufacturer where wire or cable is subsequently wound onto the fully assembled spool.

One problem with prior five-piece metal spools is that the ability to transfer torque between different spool components of a fully assembled spool is relatively poor, particularly between the flange hub and the flange. The ability to transfer torque is highly desired for wire winding or pulling functions in which wire or cable is wound tightly onto the spool typically by applying a rotational force to drive holes in the central flange hub. For a fully assembled five piece spool having a 1 and 15/16 inch diameter barrel, the tightened curl of the spool has typically only achieved between about 60 inch-lbs. and a maximum of about 100 inch-lbs. of torque load transfer (with a mean average of about 90 inch-lbs.) between the flange hub and the outer flange, using a test of applying a torque wrench to the flange hub through the drive holes while holding the outer flange fixed. However, in some applications, industry desires much higher torque load transfers between the flange hub and the outer flange, typically for wire winding or pulling functions, which makes prior five-piece metal spools insufficient for those applications.

To avoid torque load transfer problems associated with prior five-piece metal spools, industry has used three-piece metal spools in certain applications having a high torque load requirement. Three-piece metal spools typically comprise a cylindrical barrel upon which wire is wound, and a pair of flanges disposed at respective ends of cylindrical barrel. To connect the flanges to the cylindrical barrel, the cylindrical barrel includes tabs which are fit through punched out holes in the flanges. The tabs are crimped to the flanges to secure the flanges to the cylindrical barrel. Although the tab and hole mechanism provides sufficient torque transfer, three-piece spools have suffered from other strength disadvantages. More specifically, when three-piece spools carry heavy loads of wire or cable, the tabs tend to dislodge from the holes causing the flanges to pull away from the cylindrical barrel. This is especially problematic when stacking and transporting multiple three-piece spools loaded with wire or cable. The flanges of the three-piece spools can collapse under heavy loads which allows wire or cable to fall off the cylindrical barrel which in turn results in wasted wire or cable product.

SUMMARY OF THE INVENTION

It is therefore an object of the present invention to provide a practical die and practical method of assembling a metal spool that includes five-pieces which is capable of transmitting higher torque loads between the separate pieces of the spool as compared with that of the prior art.

In achieving the above objective, it is a further objective to provide a method of manufacturing a relatively inexpensive metal spool.

In accordance with these and other objectives, the present invention is directed towards a highly practical die and method for forming a formed metal curl with detents to assemble a metal spool and provide a high torque load transmissibility characteristic between the spool components. The spool is assembled from five pieces including a cylindrical barrel and a pair of flange sub assemblies in which each flange sub assembly includes an outer flange and an inner flange hub joined by a loose curl. The loose curl provides a smooth exposed curled surface on one side of the flange sub assembly and a circular curl entrance on the other side of the flange sub assembly. The cylindrical barrel includes circular edges at its opposing ends that are closely received into the circular curl entrances of the flange sub assemblies.

According to one of the aspects of the present invention, a method for forming a spool comprises the steps of first fitting the barrel into the two-piece flange sub assembly in such a way that the metal edge of the barrel fits into the curl entrance of the flange sub assembly. Then a stamping operation is applied to the loose curl, to first force the metal edge of the barrel through the curl entrance and to form it into the curl thereby securing the flange to the barrel and tightening the curl and then in the same operation form detents at a plurality of locations around the curl. Each detent extends through at least three external layers of the curl to thereby create a torque transmitting feature locking the two-piece flange sub assembly to the barrel.

According to another aspect of the present invention, a method for forming a spool comprises first arranging the flange sub assemblies on respective ends of the cylindrical barrel with respective circular ends of the cylindrical barrel being fitted into respective curl entrances. The flange sub assemblies and cylindrical barrel are also located between a pair of spaced apart dies. Each die includes a support housing, a curling member movable with respect to the support housing, a spring biasing the curling member away from the support housing, and a plurality of nibs carried by the support housing. The curling member has an annular curling face with the nibs being arranged in association with the curling face. The metal curls of the flange sub assemblies are also aligned in substantial diametric opposition with the respective annular curling faces of the dies. Finally, the flange sub assemblies and the cylindrical barrel are pressed between the dies. The step of pressing comprises two stages. During the first stage, the metal edges of the cylindrical barrel are curled into the respective curls with the annular curling face to secure the cylindrical barrel to the flange sub assemblies. During the second stage, a plurality detents are swaged into respective curls with the nibs projecting outward from the curling faces of the respective dies. The nibs project outward as the curling member of each die translates towards the support housing against the action of the spring.

According to another aspect of the present invention, a die for pressing one of the flange sub assemblies onto the cylindrical barrel to form a spool includes a body having an annular curling face that aligns in substantial diametric opposition with the loose curl of the flange sub assembly. The die presses the flange sub assembly on the spool with the curling face curling the edge of the cylindrical barrel radially outward to form a tightened curl which secures the flange sub assembly to the cylindrical barrel. The die also includes at least one and preferably a plurality of nibs arranged in association with the curling face. The nibs are moveable with respect to the curling face and project axially outward from the curling face and into the tightened curl during pressing operations to form corresponding detents in the tightened curl. The resulting detents provide increased torque transfer capacity between the flange sub assembly and the cylindrical barrel.

According to yet another aspect of the present invention, a die for forming a spool includes a support housing and a curling member that is adapted to move relative to the support housing. The curling member includes an annular curling face that aligns in substantial diametric opposition with the loose curl of the flange sub assembly. The curling member includes a plurality of slots extending through the curling face. The die further includes a plurality of nibs carried by the support housing and arranged in the slots in the curling face. A relatively heavy gauge spring is interposed between the curling member and the support member so as to bias the curling member away from the support housing. The die includes first and second pressing stages. During the first pressing stage, the die presses the flange sub assembly onto the cylindrical barrel with the curling face curling the circular edge of the cylindrical barrel radially outward into the curl to form a tightened curl that secures the flange sub assembly to the cylindrical barrel. During the second pressing stage, the curling member moves towards the support housing against the bias of the spring to expose the nibs. The nibs project outward from the curling face and into the tightened curl to form a plurality of detents therein. The detents in the tightened curl provide increased torque transfer capacity between the cylindrical barrel and the flange sub assembly.

These and other aims, objectives, and features of the invention will become more apparent from the following detailed description when taken in conjunction with the accompanying drawings.

Figure 1:
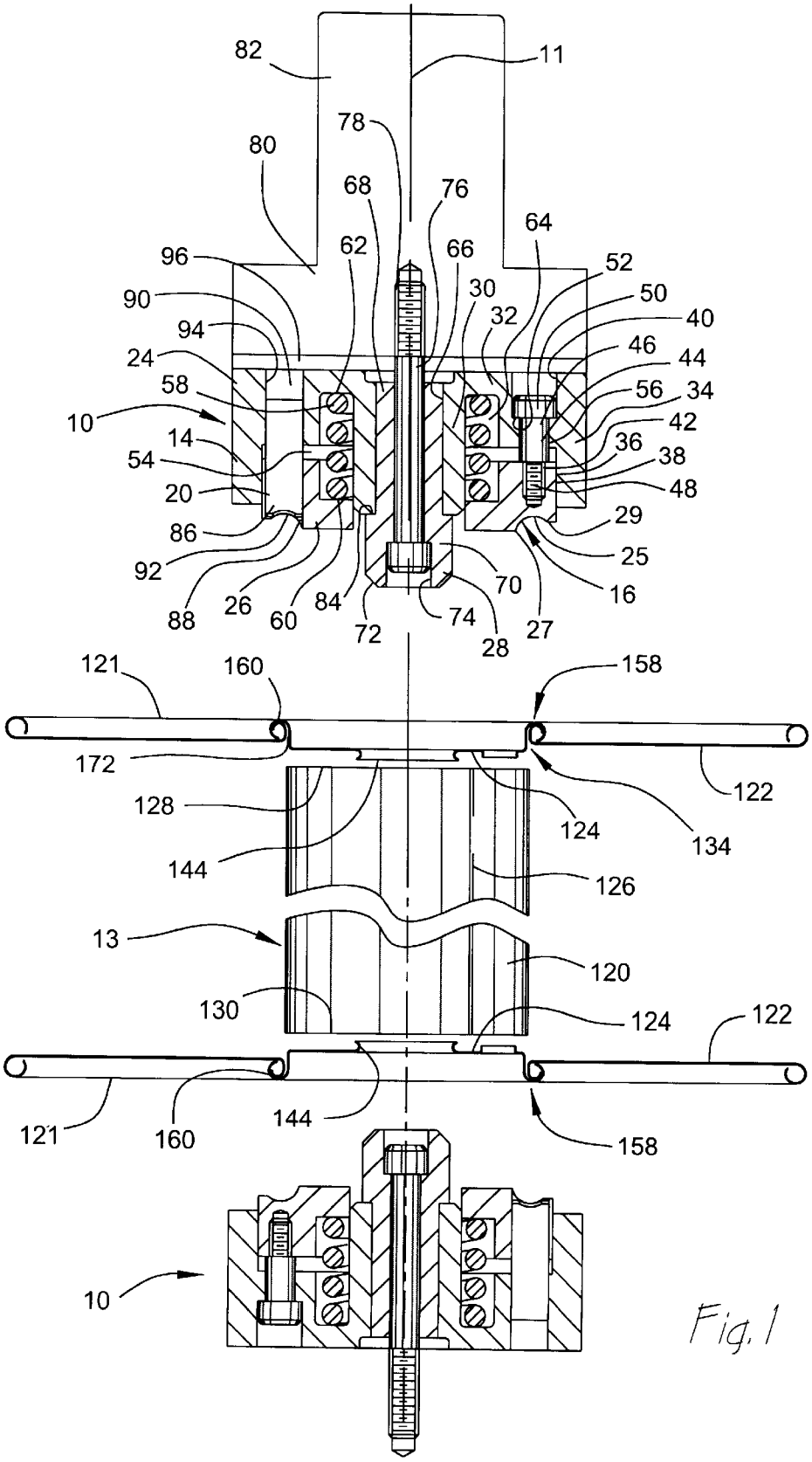
FIG. 1 is a cross-sectional view of a die assembly including diametrically opposed dies for forming a high torque metal spool from a spool assembly therebetween, in accordance with a preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 2:
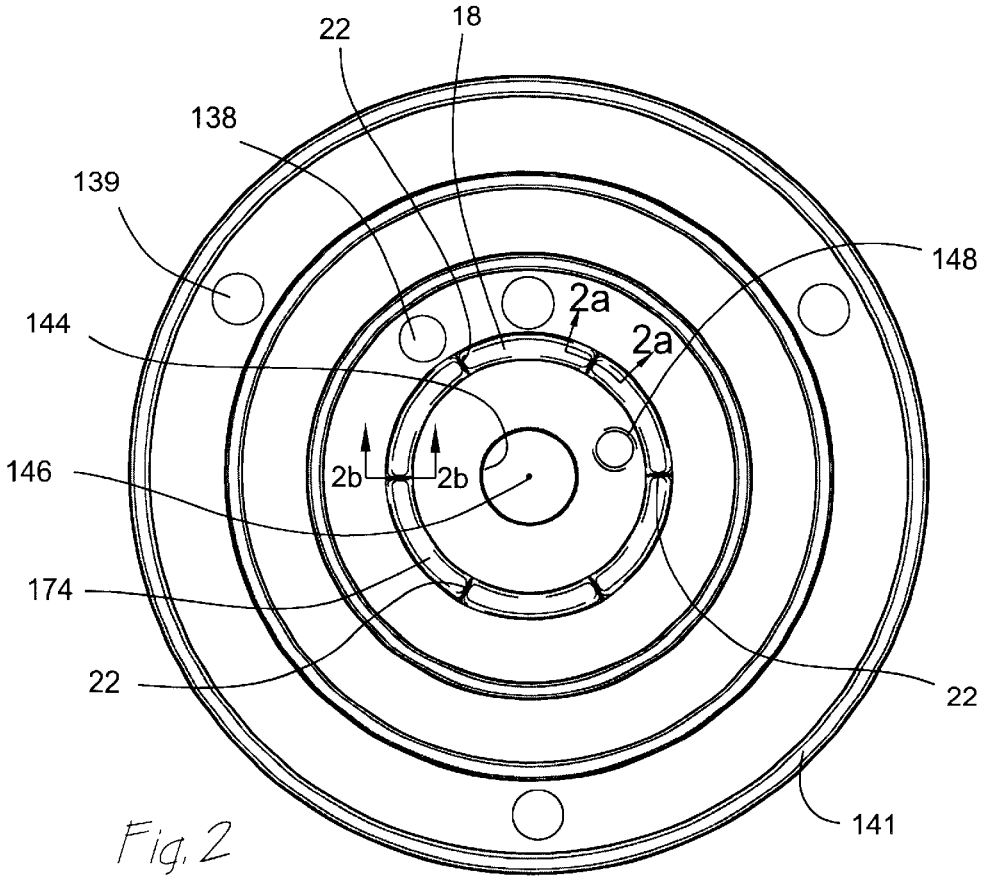
FIG. 2 is a front view of an embodiment of a spool that has been assembled between the dies of FIG. 1.
Figure 2A:
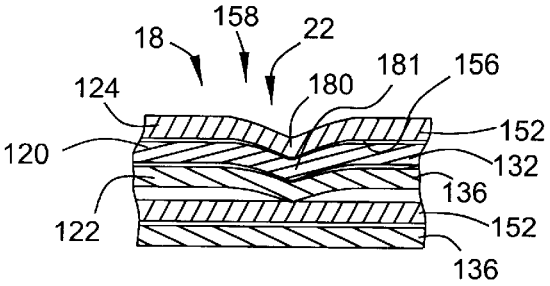
FIG. 2*a* is an enlarged cross-sectional view taken about line 2*a*—2*a* in FIG. 2.
Figure 2B:
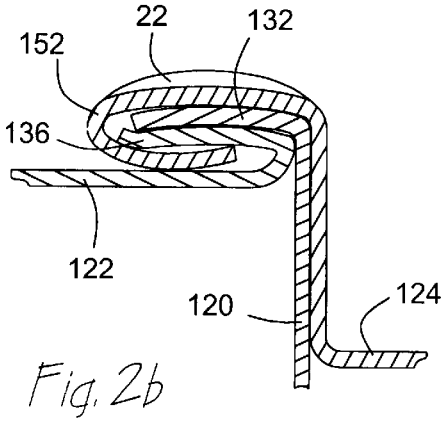
FIG. 2*b* is an enlarged cross-sectional view taken about line 2*b*—2*b* in FIG. 2.
Figures 3, 3A:
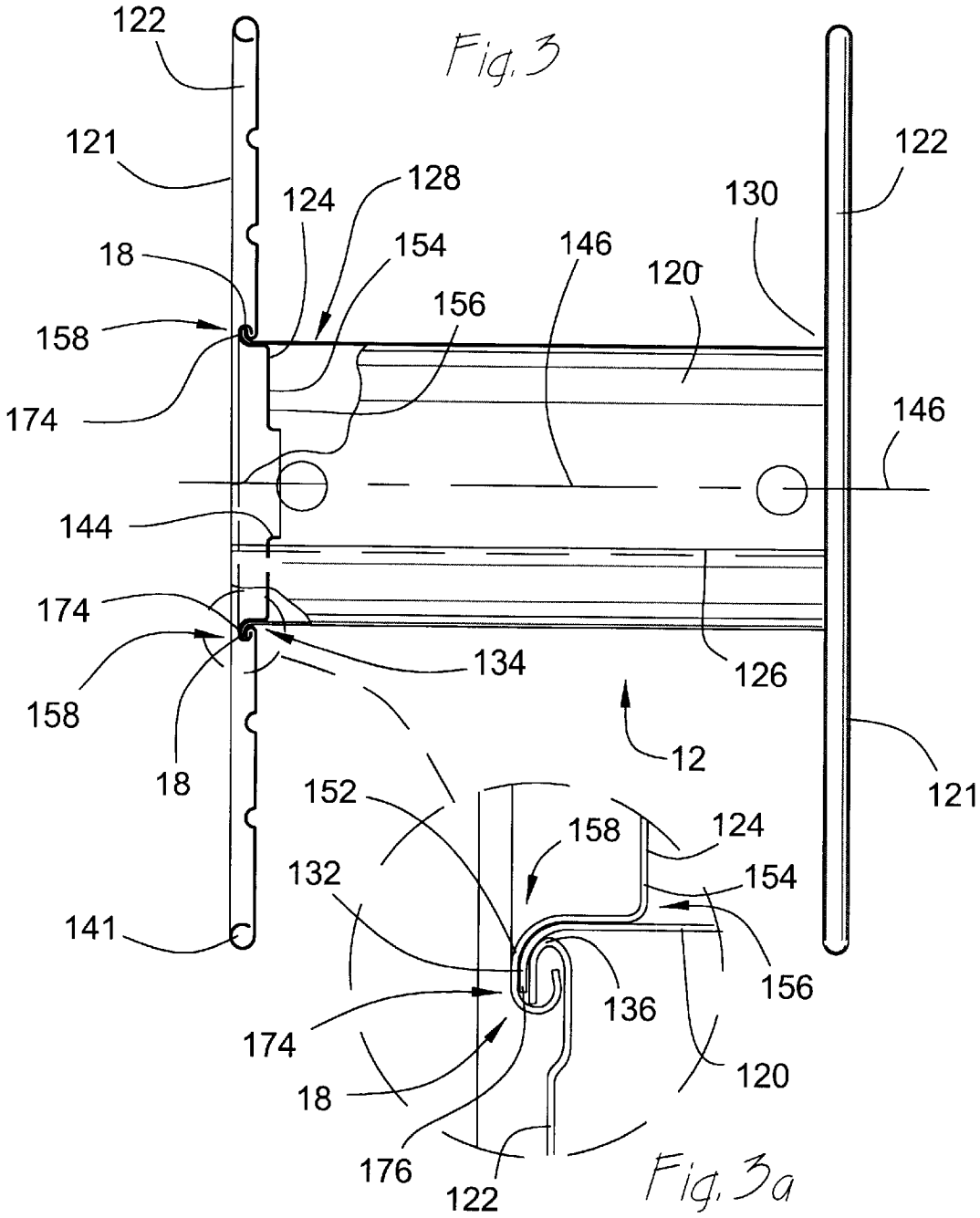
FIG. 3 is a side view of FIG. 2 shown in partial cross-section.
FIG. 3*a* is an enlarged view of a portion of FIG. 3.
Figure 4:
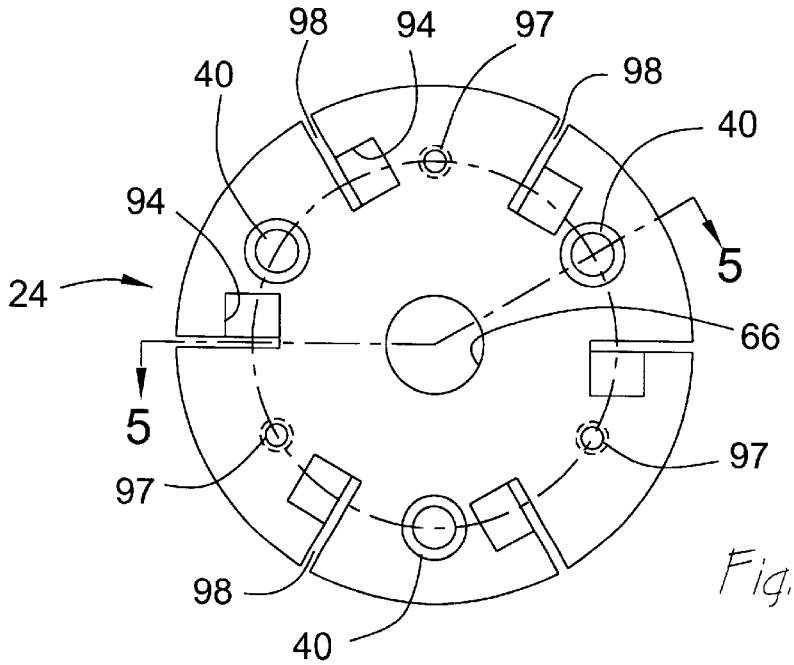
FIG. 4 is a plan view of the support housing of a die shown in FIG. 1.
Figure 5:
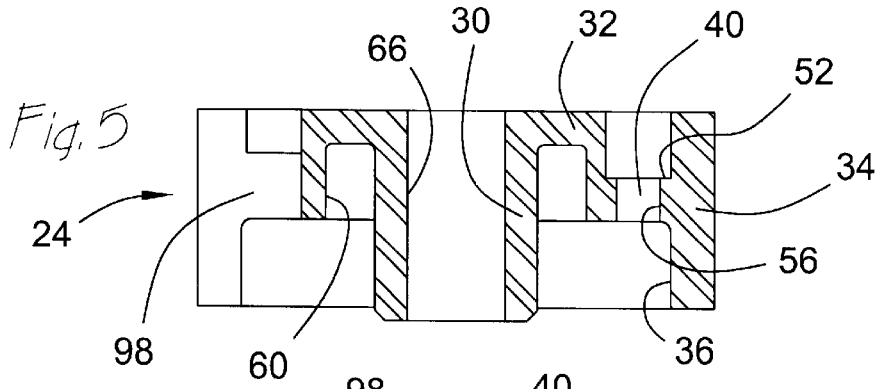
FIG. 5 is a cross-section view of FIG. 4 taking about line 5—5.
Figure 6:
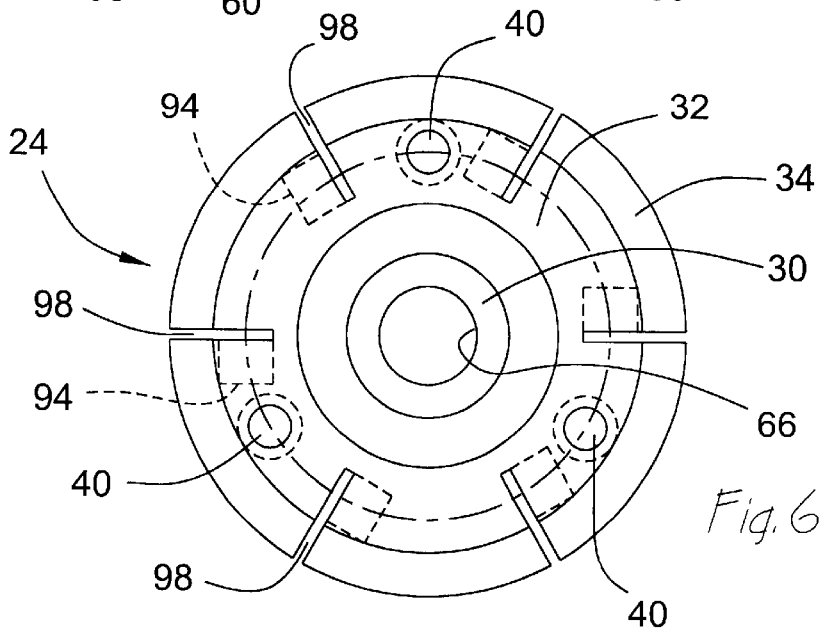
FIG. 6 is a bottom view of FIG. 4.
Figures 13, 14, 15:
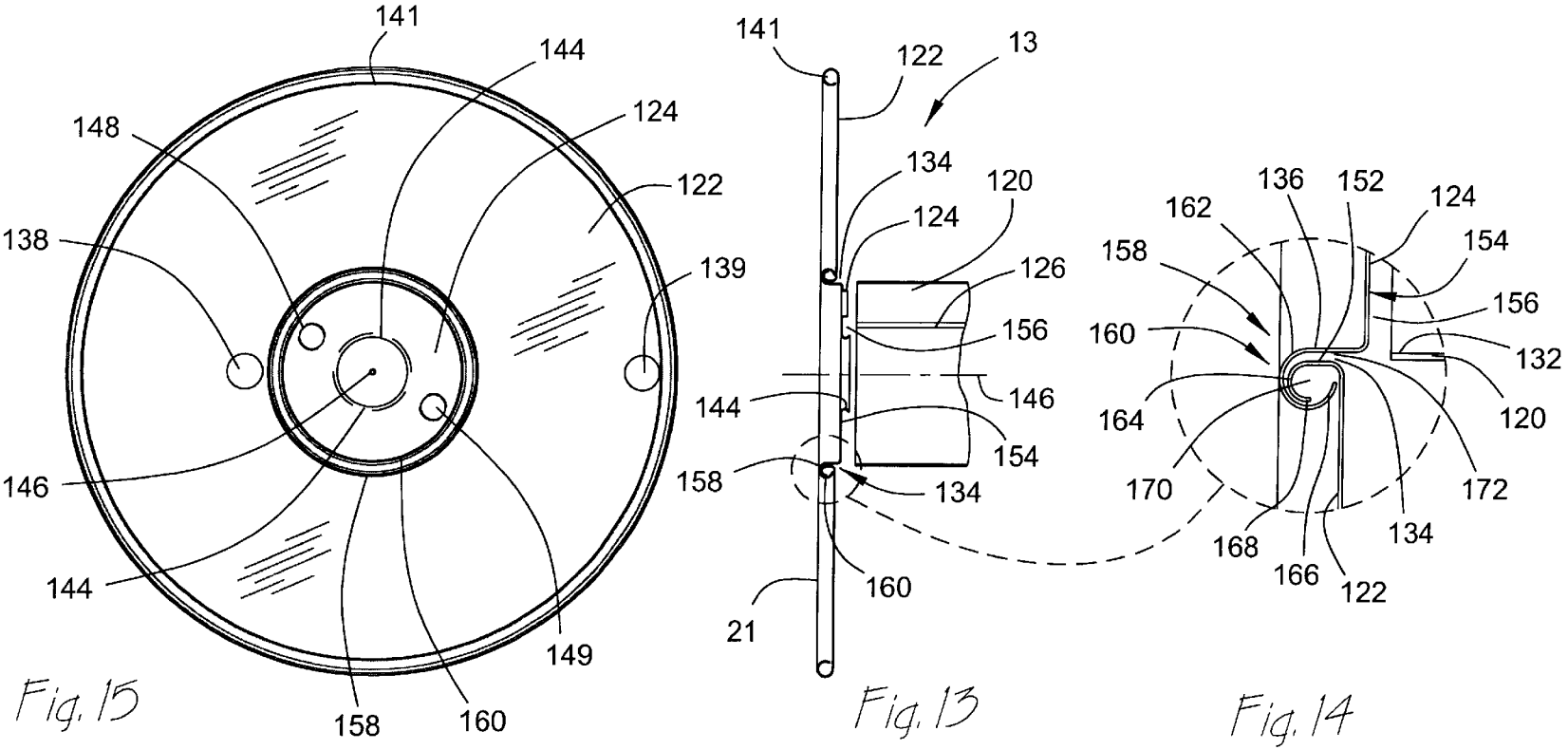
FIG. 13 is a pre-assembled partially fragmentary view of an embodiment of spool components that are ready to be assembled by the die of FIG. 1.
FIG. 14 is an enlarged view of a portion of FIG. 13.
FIG. 15 is front view of a part shown in FIG. 13.

In accordance with a preferred embodiment of the present invention, an embodiment of a fully assembled spool 12 formed by the disclosed method and that may be formed between the matching dies 10 (FIG. 1) is shown in FIGS. 2–3. Another embodiment of a partially-assembled spool assembly 13 for use with the disclosed method and dies 10 is illustrated in FIGS. 13–15. For the spool 12 and spool assembly 13, like numerals designate like parts in FIGS. 1, 2, 2*a*, 2*b*, 3, 3*a*, and 13–15. The spool 12 is assembled from five-pieces including a cylindrical barrel 120, and preferably a pair of pre-assembled two-piece flange sub assemblies 121. Each flange sub assembly 121 includes an outer flange 122 and an inner flange hub 124. The cylindrical barrel 120 may be formed from sheet metal rolled into a tubular structure with opposing parallel edges being seamed together at an axial seam 126. The cylindrical barrel 120 extends between two ends 128, 130 with cylindrical or otherwise circular edges 132 disposed at each respective end 128, 130. Each flange 122 may be stamped from sheet steel into a generally disc shaped body to include a central opening 134 for closely receiving one of the ends 128, 130 of the cylindrical barrel 120 and the flange hub 124. Each flange 122 includes an annular edge 136 at its inner periphery surrounding the central opening 134. The flanges 122 preferably include a starting hole 138 disposed radially inward for receiving the starting strand of wire or cable and a finishing hole 139 disposed radially outward for receiving the cut or terminating strand of wire or cable. As shown in the embodiment of FIGS. 2 and 3, the flanges 122 may also have support ribs 140 for increased strength and a safety curl 141 at its outer radial periphery for safety purposes. The flanges 122 may also have label panels (not shown) formed into the metal for labeling purposes if desired. As shown in the embodiment of FIGS. 13 and 15, the flanges 122 may also be substantially radially planar without label panels or support ribs. Each flange hub 124 may also be stamped from sheet steel to include a center pilot hole 144 about a center axis 146 for closely receiving the center pilot 28 (FIG. 1) and providing support means for receiving a rod support (not shown) upon which the spool 12 may be mounted or rest, and a pair of 180° degree apart drive holes 148, 149 (FIG. 13) for receiving the driving mechanism which rotates the spool to wind wire or cable tightly onto the spool. The flange hub 124 also includes an annular edge 152 at the outer periphery thereof The edges 132, 136, 152 of the spool components are curled together in a tightened curl 18 that secures the spool 12 together.

At least one and preferably a plurality of detents 22 are formed into the curl 18 to provide a torque transfer feature locking the spool components together. The depth of the detents 22 in the tightened curl 18 is selectively controlled to maximize torque load transfer capacity through the tightened curl 18. However, the detents 22 preferably do not puncture the outside surface 174 of the curl 18 to prevent creation of sharp projecting metal edges that could pose a potential safety hazard. Referring to FIG. 2*a*, the detents 22 preferably extend through a portion of each of the annular edges 132, 136, 152 to provide beveled surface to surface contacts 180, 181 between the edge 132 of the cylindrical barrel 120 and each of the annular edges 136, 156 of the flange hub 124 and flange 122 to accomplish a higher capacity for transmitting torque loads between the flange hub 124 and the flange 122. The beveled contacts 180, 181 provides direct transfer of tangential forces in the curls between the barrel 120, flange 122 and flange hub 124 which thereby increases the torque transmitting capacity of the spool 12.

The inside face 154 or a portion of the inside face 154 of the flange hub 124 is preferably coated with a thin coat of flattening paste 156. The flattening paste 156 may be a modified vinyl such as that sold under the trade name 35S1 FLAT VARNISH commercially available from the BASF CORPORATION, or alternatively some other friction amplifying coating material. The flattening paste increases the coefficient of friction of standard spool sheet steel. In addition or in the alternative to flattening paste 156 on the inside face 154 of the flange hub 124, flattening paste may also be applied to coat the inside face of a portion thereof of the flange 122 and/or the inside or outside circumference of the ends or edges 132 of the cylindrical barrel 120. In any event, the flattening paste adheres to a metal surface inside the metal curl 18 between the contacting metal surfaces of two adjacent metal edges to increase the friction and therefore the torque transfer capacity therebetween.

Figure 16:
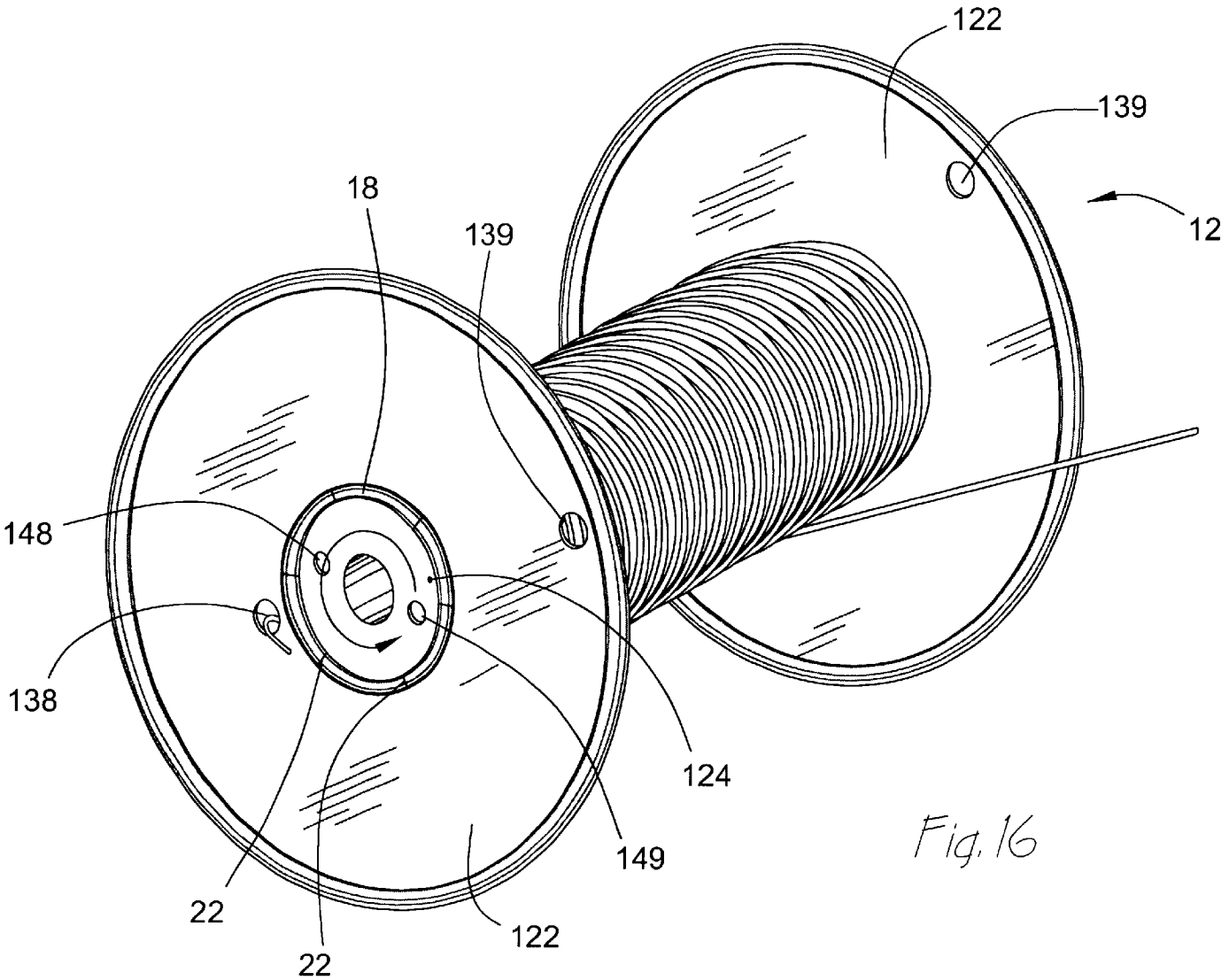
FIG. 16 is a perspective view of wire being wound onto a spool of the preferred embodiment.

The spool 12 is particularly advantageous for wire winding functions in which wire or cable is tightly wound onto the spool 12 as shown in FIG. 16. To wind wire on the spool 12, a starting strand of wire is connected to the starting hole 138 and crimped thereto. Then, a drive mechanism inserted into one or both of the drive holes 148, 149 rotates the flange hubs 124 which in turn rotates the barrel 120 and flanges 124 to tightly spin wire or cable on the spool 12. Once the spool is filled with wire or cable as desired, the wire or cable may be cut and the resulting terminating strand of wire can be inserted into the finishing hole 139 and crimped to prevent the wire or cable from unraveling from the spool 12. Advantageously, the detents 22 and flattening paste 156 increase torque transfer between the flange hub 124, where rotary force is applied, and the barrel 120 and flange 122 which transfer force to the wire to wind the wire or cable onto the spool 12.

The torque load transmissibility characteristic of the fully assembled spool 12 depends in part upon the diameter of the cylindrical barrel 120 and the tightened curl 18. Through statistical experimental testing on a fully assembled spool having a 1 and 15/16 inch diameter cylindrical barrel, the following strength characteristics have been found utilizing a standard torque wrench to apply force to the drive holes of the flange hub while holding the outer flange fixed to determine a torque transmissibility characteristic. In a spool including the flattening paste applied to the face of the flange hub alone without the detents in the tightened curl, the torque transmissibility characteristic is increased (from a mean average of about 90 inch-lbs. as per the prior art method set forth in the background section) to between about 140 inch-lbs. and 200 inch-lbs. with a mean average of about 172 inch-lbs. In a spool including the detents in the curl without utilizing flattening paste, the torque transmissibility characteristic is increased to between about 100 inch-lbs. and 180 inch-lbs. with a mean average of about 147 inch-lbs. In a spool including the flattening paste applied to the face of the flange hub along with the detents, the torque transmissibility characteristic is increased to between about 200 inch-lbs. and 400 inch-lbs., with a mean average of about 300 inch-lbs. Thus, it has been found the combination of the flattening paste and detents compliment each other and amplify each others effect. Whether either or both the detents and flattening paste are necessary is determined in part by the torque transmissibility requirements of the particular application. In any event, the spool is provided with a mean average torque transmissibility characteristic at least over about 140 inch-lbs. It will also be appreciated that the actual torque transmissibility characteristic may also depend upon the selected depth and number of detents and the number of metal surfaces in the curl that the flattening paste is applied to. Therefore, achieving a torque transmissibility characteristic well over 400 inch-lbs. may certainly be achievable if so desired for a 1 and 15/16 inch diameter barrel.

According to a preferred method of assembly, each flange hub 124 is partially assembled with one flange 122 in a relatively loose curl 160 to provide a pre-assembled flange sub assembly 121 as illustrated in FIGS. 1, and 13–15. The loose curl 160 includes a curled segment 162 of the flange hub 124 that is bent radially outward which is loosely interlocked with a corresponding curled segment 164 of the flange 122 that is bent axially outward and also radially outward. The curled segment 162 of the flange hub 124 includes an end segment 166 which projects radially inward and has a smaller diameter than a radially outward end segment 168 of the flange 122. The outward end segment 168 of the flange 122 forms an annular channel 170 that catches the inward end segment 166 of the flange hub 124 therein, thereby achieving a loose attachment joining the flange hub 124 with the flange 122. The loose curl 160 is loose enough such that there is a circular curl entrance 172 between the flange 122 and the flange hub 124 that is sized to closely receive the end or circular edge 132 of the cylindrical barrel 120, which is cylindrical in the pre-pressed state.

In accordance with one of the aspects of the present invention, a method of assembling the spool 12 with the locking feature of the detents 22 increasing torque transfer capacity is provided in accordance with a preferred embodiment. To fully assemble the spool 12, the circular edge 132 of the cylindrical barrel 120 is closely fitted into the circular curl entrance 172. The circular edge 132 can either be easily received into the curl entrance 172 or forcibly wedged therein. Then the partially assembled spool 12 is subjected to a two stage stamping operation to tighten the curl and subsequently form detents therein. During the first stage the circular edge 132 of the barrel 120 is forced further into the curl entrance 172 and formed radially outward between the metal edges 136, 152 of the hub 124 and the flange 122, to provide a tightened curl 18. At this point, the tightened curl 18 includes a smooth exposed curled surface 174 (FIG. 2) and the annular edges 136, 152 frictionally engage the edge 132 of the cylindrical barrel 120 therebetween, as shown in FIG. 3*a*. During the second stage, detents 22 (See FIGS. 2 and 2*a*) are formed into the face 174 of the tightened curl 18, thereby increasing the torque load capacity of the metal spool 12. The first stage is fully or substantially complete before beginning the second stage so that the detents 22 do not interfere with the outward deformation of the circular edge 132 of the barrel 120 into the curl 18. This ensures that the cylindrical barrel 120 is relatively rigidly secured to each of the flange sub assemblies 121.

In accordance with another aspect of the present invention referring to FIG. 1, a pair of matching dies 10 are shown to illustrate the preferred tool for accomplishing the method of assembling the spool 12. The dies 10 are mounted in diametrical opposition with one another along an axis 11 for relative movement towards and away from each other to press a metal spool assembly 13 therebetween and form a metal spool 12 (FIGS. 2 and 3). The die 10 generally includes a die body 14 having an annular curling face 16 for curling closely interfitting metal edges 158 of the spool assembly 13 into a tightened curl 18 (FIGS. 2 and 3) to secure the spool 12 together, and at least one and preferably a plurality of nibs 20 that are movable relative to the annular curling face 16 for forming a plurality of corresponding detents 22 (FIG. 2) in the tightened curl 18 to provide for increased torque transfer capacity between spool components.

Figure 7:
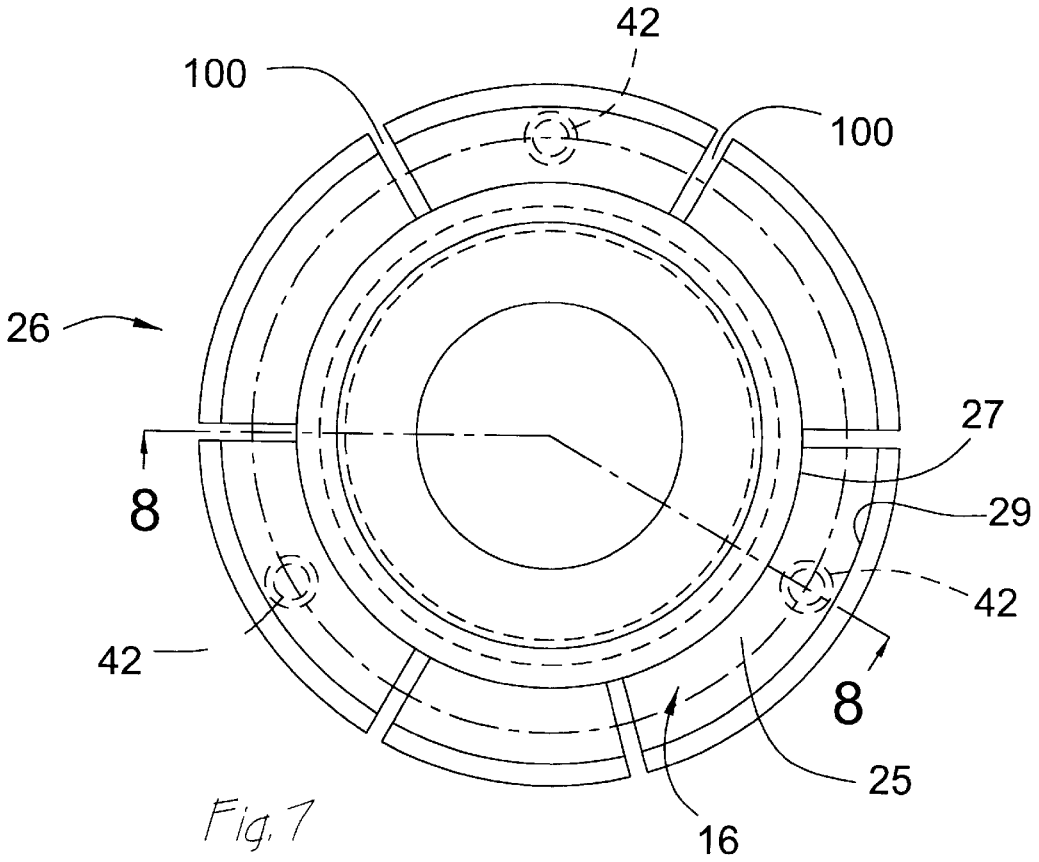
FIG. 7 is a bottom view of the curling member of a die shown in FIG. 1.
Figure 8:
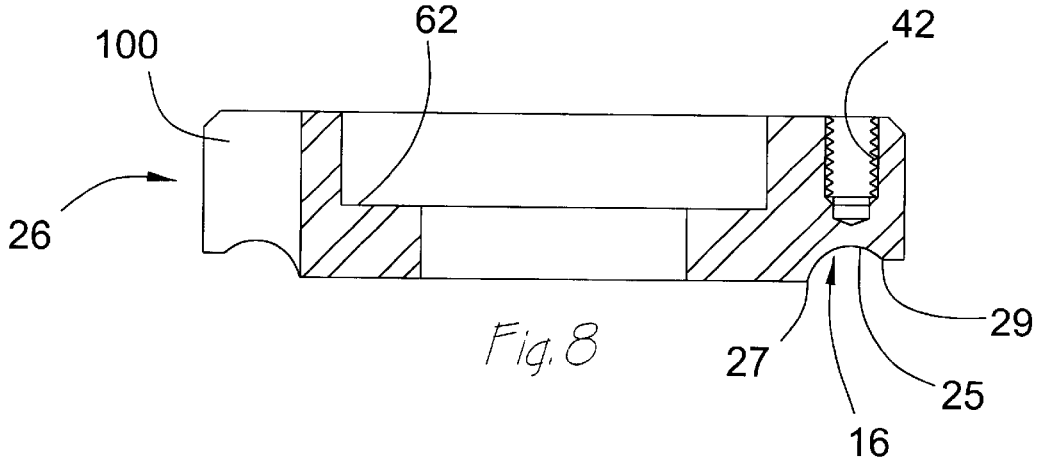
FIG. 8 is a cross-sectional view of FIG. 7 taken about 8—8.
Figure 10:
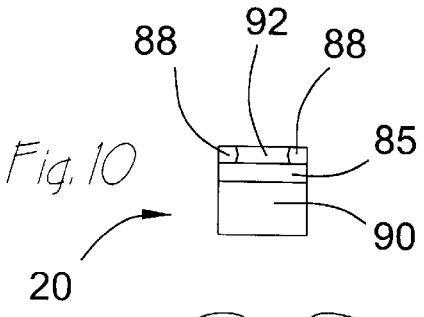
FIGS. 9–11 are front, top and side views of a nib used in a die of FIG.
Figure 11:
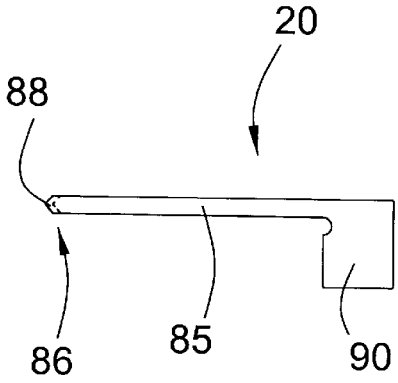
Figure 9:
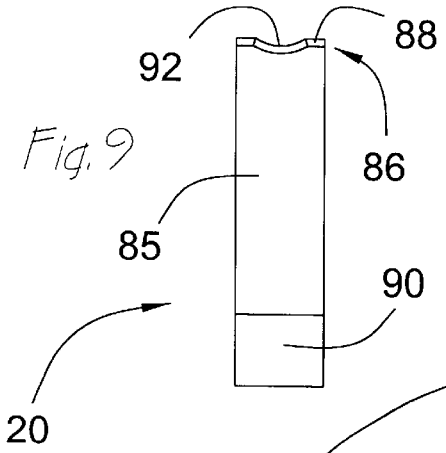

In the preferred embodiment, the die body 14 comprises a support housing 24, a curling member 26 that is adapted to move axially relative to the support housing 24, and a center pilot 28. The curling member 26 provides the annular curling face 16 for engaging and curling the metal edges of the spool assembly 13 together. As shown in FIGS. 1 and 7–8, the curling face 16 extends radially outward and recesses axially along an arc or curve shaped cross section 25 between two annular edges 27, 29.

Figure 1A:
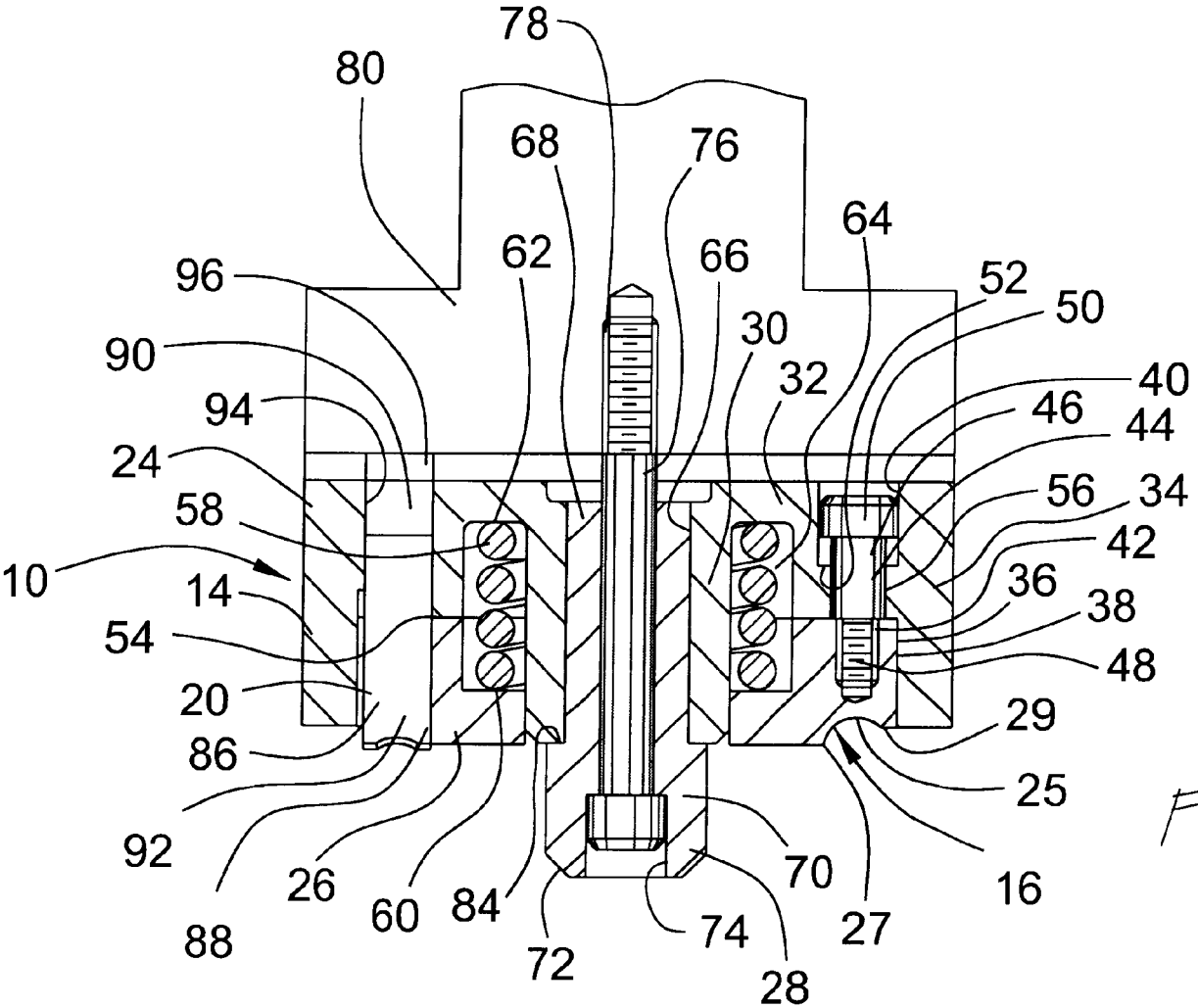
FIG. 1*a* is an enlarged fragmentary cross-sectional view of the die assembly shown in FIG. 1 in an alternate position.

Referring to FIGS. 1 and 4–6, the support housing 24 includes a generally cylindrical inner flange hub 30 connected by a radially outward top portion 32 to a generally cylindrical outer rim 34. The outer rim 34 may include an inner cylindrical guide surface 36 that corresponds with an outer cylindrical peripheral guide surface 38 of the curling member 26 to assist in guiding axial translation between the curling member 26 and the housing 24. The radially outward top portion 32 includes a plurality of counter sunk bores 40 disposed radially about the center axis 11 aligned with a plurality of tapped threaded holes 42 in the curling member 26. A plurality of shoulder bolts 44 attach and align the curling member 26 with the housing 24. Each shoulder bolt 44 includes a smooth cylindrical portion 46 slidably disposed in the smooth inner cylindrical surface 56 of the respective counter sunk bore 40 and a threaded end portion 48 threadingly fastened to one of the threaded holes 42. The head 50 of each shoulder bolt 44 engages a generally radially planar seating surface 52 of the respective counter sunk bore 40 so as to act as mechanical stop to regulate a gap 54 between the curling member 26 and the support housing 24. As shown in FIG. 1*a*, the curling member 26 is capable of moving axially toward the support housing 24 thereby narrowing the gap 54 and causing the heads 50 to lift off the seating surface 52. During such movement, the smooth cylindrical portions 46 of the shoulder bolts 44 ride smoothly along the inner cylindrical surface 56 of the counter sunk bore 40 to maintain radial alignment between the support housing 24 and curling member 26.

The curling member 26 is biased away from the support housing 24 by a relatively heavy gauge spring 58 disposed generally coaxial over the inner flange hub portion 30. The radially outward top portion 32 includes an annular recess 62 diametrically opposed with a corresponding annular recess 60 in the curling member 26 to provide a spring chamber 64 which houses the spring 58. The bias of the spring 58 in the dies 10 is generally selected to match the thickness and hardness of sheet steel used in the spool components to attempt to maximize resulting torque load transfer capacity. In particular, the spring 58 has a force great enough to allow the first stage to be sufficiently complete such that the tightened curl 18 is substantially complete before allowing the nibs 22 to project outward into the curl 18, but not great enough to prevent the nibs from projecting into the curl 18 during the second stage.

The inner flange hub 30 of the support housing 24 defines a central bore 66 about the axis 11 that slidably receives an elongate stem portion 68 of the center pilot 28. The center pilot 28 also includes a central counter bore 74, and an enlarged pilot head 70 having a beveled annular aligning surface 72 for centering the spool assembly 13 between the dies 10 during assembly. An elongate shoulder bolt 76 is disposed in the central counter bore 74 and may be fastened into a threaded hole 78 of a mounting adapter 80. The mounting adapter 80 generally includes a shank 82 which can be secured to a machine driven ram (not shown) or a stationary support (not shown). The pilot head 70 of the center pilot 28 also includes a radially outboard shoulder 84 which engages the support housing 24 to fix the support housing 24 to the mounting adapter 80.

Figure 12:
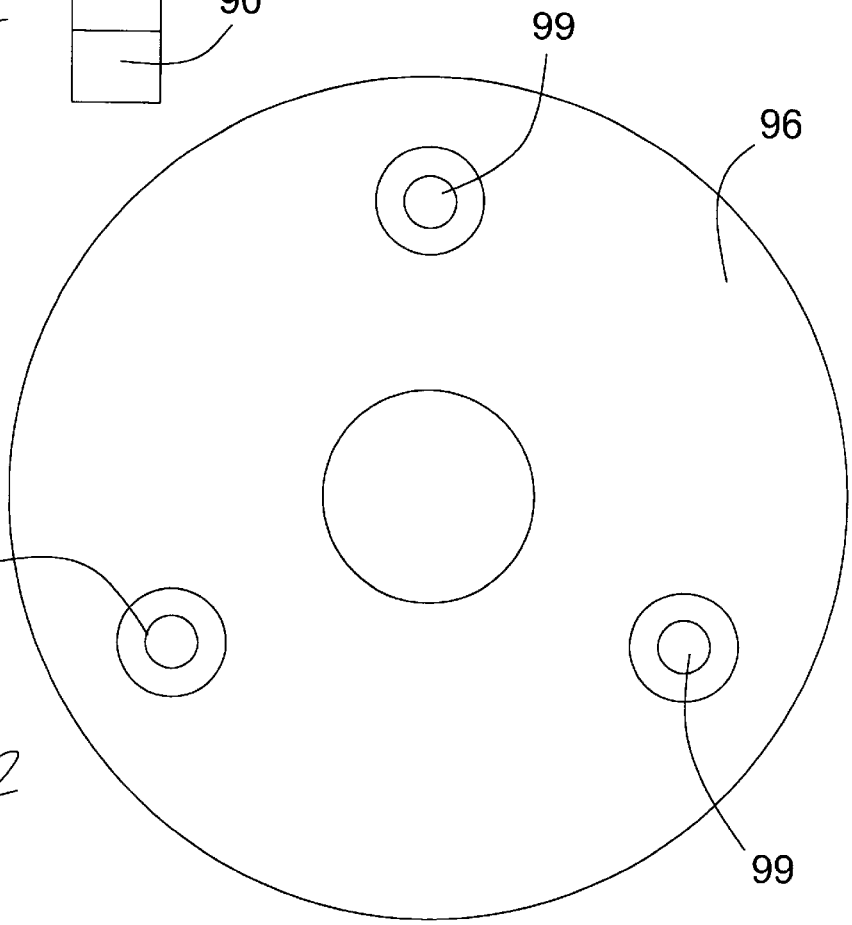
FIG. 12 is a top view of the spacer plate used in a die of FIG. 1.

The nibs 20 are secured to the support housing 24 for movement relative to the curling face 16 of the curling member 26. Referring to FIGS. 1 and 9–11, each nib 20 of the preferred embodiment is provided by an elongate blade 85 having a notching end 86 at one end and a support block 90 at the opposing end. The notching end 86 includes a radially extending notching edge 88 which may include a slight annular recess segment 92 contoured generally to the outer surface of the tightened curl 18 formed on the spool 12 and interposed generally intermediate thereon. The annular recess segment 92 allows the nibs 20 to engage the curl 18 more evenly and also helps to provide alignment. The support blocks 86 are closely received in a plurality of respective pits 94 (FIG. 4) formed in the top portion 32 of the support housing 24. The support blocks 86 may have a rectangular or generally cubical shape as shown or may be cylindrical or other appropriate shape that is preferably matched to the shape of the pits 94. The support blocks 86 may be clamped in their respective pits 94 by a spacer plate 96 (FIGS. 1 and 12) which covers the top portion 32 of the support housing 24 and is interposed between the adapter 80 and the die body 14 to provide a selective spacing therebetween. A plurality of set screws (not shown) or other fasteners may be used to connect the spacer plate 96 to the support housing 24 via diametrically aligning holes 97, 99 (See FIGS. 7 and 12). The blades 85 are slidably disposed in axially extending and aligned slots 98, 100 in the support housing 24 and curling member 26, respectively. The slots 98, 100 generally connect the pits 94 to the curling face 16.

To fully assemble the spool 12 utilizing the die 10, the circular edge 132 of the cylindrical barrel 120 is closely fitted into the circular curl entrance 172. The circular edge 132 can either be easily received into the curl entrance 172 or forcibly wedged therein. The partially assembled spool 12 is also located and generally aligned between the matching dies 10 such that the curling face 16 is in substantial diametric opposition with the loose curl 160. If the matching dies 10 are aligned vertically, the spool assembly 13 may be inserted onto the lower die 10 with the center pilot 28 received into the center pilot hole 28. Then the partially assembled spool 12 is pressed between the matching dies 10. During the first stage of pressing, the center pilots 28 are received into the pilot holes 144 in the flange hubs 124 to more accurately align the axis 11 of the dies 10 with the center axis 146 of the spool 12 and therefore place the annular curling face 16 in more accurate diametric opposition with the loose curl 160. During the first stage the dies 10 force the circular edges 132 further into the curl entrance 172, then the arc shaped cross section 25 of the curling face 16 engages the loose curl 160, curls the metal edges 132, 136, 152 radially outward and compresses the loose curl 160 into the more tightly compressed tightened curl 18. At this point, the tightened curl 18 includes a smooth exposed curled surface 174 (FIG. 2) and the annular edges 136, 152 frictionally engage the edge 132 of the cylindrical barrel 120 therebetween. More specifically, the circular edge 132 of the cylindrical barrel 120 is deformed radially outward to provide a radially outward projecting annular lip 176 (FIG. 3*a*) that is tightly and frictionally compressed by a resistance fit between the annular edges 136, 152 of the flange 122 and flange hub 124. The circular edge 132 of the barrel 120 is generally stretched out and its outward deformation progress is stopped by the outward end segment 168 of the metal edge 136 as well as from the annular edge 152 of the flange hub 124. This resistance increases the amount of axial force necessary for further curling the curl radially outward which provides resistance against the die 10 to overcome the action of the spring 58. During the second stage of pressing, the matching dies 10 are pressed even closer and the force of the spring 58 is overcome by virtue of the increased resistance which translates the curling member 26 axially towards the support housing 24 to expose the notching ends 88 of the nibs 20. The maximum exposure of the nibs 20 may be determined by the gap 54 between the support housing 24 and curling member 26 which also controls the maximum depth of the detents 22. The exposed notching ends 88 project outward from the curling face 16 and into the tightened curl 18 to form the corresponding detents 22 (See FIGS. 2, 2*a* and 2*b*) in the face 174 of the tightened curl 18, thereby increasing the torque load capacity of the metal spool 12. The two stage stamping or pressing operation in which the tightened curl 18 is substantially or fully complete before the formation of the detents 22 prevents the nibs from interfering with the radially outward deformation of the ends 132 of the cylindrical barrel 120. This ensures that the cylindrical barrel 120 is relatively rigidly secured to each of the flange sub assemblies 121.

An advantage of method of assembly described above is that the preassembled flange sub assemblies 121, which include flange hubs 124 pre-joined with the flanges 122, may be transported closely together and multiple cylindrical barrels 120 may shipped closely together. Then the cylindrical barrels 120 can be later pressed with the preassembled flange sub assemblies 121 after transportation at a different location typically at where wire is wound onto the spools, thereby minimizing the amount of void space during transportation that would otherwise result if empty spools 12 were transported. The two stage dies 10 also provides for easy assembly of the cylindrical barrel and flange sub assemblies at the plant or location where wire is wound onto the spool. Advantageously, no additional labor or space is needed to accomplish assembly of the spool while achieving the advantages of increases in torque load transmissibility. It will be appreciated that in a less preferred method, at least one detent may be formed in the curl by a separate operation utilizing a tool separate from the die. Certain broader claims appended hereto are meant to include such less preferred methods.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A method of assembling a spool from a two-piece sheet metal flange sub assembly and a formed metal barrel, the two-piece flange sub assembly made up of an inner flange hub and an outer flange joined by a loose curl having an exposed curled surface on one side of the flange sub assembly and a circular curl entrance on the other side of the flange sub assembly, the barrel having a circular metal edge with a diameter of about the size of the curl entrance, the method comprising the steps of:

fitting the barrel into the two-piece flange sub assembly in such a way that the metal edge fits into the curl entrance of the flange sub assembly;

applying a stamping operation to the loose curl, to force the metal edge through the curl entrance and form it into the curl thereby securing the flange sub assembly to the barrel and tightening the curl; and forming at least one detent at at least one location around the curl, each detent extending through at least three external layers of the curl to thereby create a torque transmitting feature locking the two-piece flange sub assembly to the barrel.

2. The method of claim 1 further comprising the step of applying a coat of friction amplifying material to a metal surface that is formed into the curl prior to forming the curl.

3. The method of claim 1 further comprising the step of forming the metal edge of the barrel radially outward into the curl until resistance from the curl substantially stops the outward deformation of the metal edge during first stage and subsequently forming the detents in the curl during a second stage once the formation of the curl is substantially complete.

4. The method of claim 1 further comprising the step of controlling the depth of the detents to provide a predetermined magnitude of the torque transmitting feature while preventing the detents from puncturing an exposed metal surface of the curl.

5. The method of claim 1 wherein the stamping operation is completed with a die, the die comprising a die body having an annular curling face aligning in substantial diametrical opposition with the curl, a plurality of nibs carried by the body arranged in association with the curling face, the die body pressing the flange sub assembly on the barrel with the curling face forcing the metal edge into the curl entrance and curling the metal edge radially outward to secure the barrel with the flange sub assembly during the first stage, each nib projecting axially outward from the curling face and into the tightened curl during the second stage to form the detents.

6. The method of claim 1 wherein the applying and forming steps are performed after the fitting step.

7. A method of assembling a spool from a pair of sheet metal flange sub assemblies and a formed metal cylindrical barrel, each flange sub assembly made up of an inner flange hub and an outer flange joined by a loose curl having an exposed curled surface on one side of the flange sub assembly and a circular curl entrance on the other side of the flange sub assembly, the barrel having circular metal edges at opposing ends thereof with a diameter of about the size of the curl entrances, the method comprising:

arranging the flange sub assemblies on respective ends of the cylindrical barrel with respective metal edges of the cylindrical barrel being fitted into respective curl entrances with the flange sub assemblies and the cylindrical barrel being located between a pair of spaced apart dies, each die comprising a die body having an annular curling face, and nibs carried by the body arranged in association with the curling face;

aligning the curls in substantial diametric opposition with respective annular curling faces of the dies;

pressing the aligned flange sub assemblies and the cylindrical barrel between the dies, the step of pressing comprising two stages, including:

(a) curling the metal edges of the cylindrical barrels into the respective curls with the annular curling face, to thereby secure the cylindrical barrel to the flange sub assemblies; and (b) forming a plurality detents into respective curls with the nibs projecting outward from the curling faces of the respective dies and into the respective curls.

8. The method of claim 7 wherein each die includes a support housing, a curling member movable with respect to the support housing, and a spring biasing the curling member away from the support housing, the nibs being fixed relative to the support housing, the curling member providing the annular curling face, and wherein the curling member of each die translates towards the support housing against the spring during the second stage to expose the nibs.

9. The method of claim 8, further comprising matching the force of the spring to strength of the metal in the curl to prevent the nibs from interfering with the curling step but allowing the nibs to project into the tightened curl during the swaging step sufficient to extend the notches into the metal of each of the inner flange hubs, the flanges and the cylindrical barrel.

10. The method of claim 7 further comprising the steps of connecting a starting strand of wire or cable to the outer flange; and rotating the inner flange hub while transmitting torque between the flange hub and the rest of the spool to spin the wire or cable onto the spool.

11. The method of claim 7 further comprising the step of forming the metal edge of the barrel radially outward into the curl until resistance from the curl substantially stops the outward deformation of the metal edge during the first stage and subsequently forming the detents in the curl once the formation of the curl is substantially complete.

12. The method of claim 7 further comprising the step of stopping the extent to which the nibs project outward from the curling face to control the depth of the detents to provide a predetermined magnitude of the torque transmitting feature while preventing the detents from puncturing an exposed metal surface of the curl.

* * * * *